US012692766B1

(12) United States Patent
Nebiolo et al.

(10) Patent No.: US 12,692,766 B1
(45) Date of Patent: Jul. 28, 2026

(54) MULTI-CYCLE CIRCULATION VALVE ACTIVATED BY BALLS

(71) Applicant: UNIVERSAL COMPLETIONS LLC, Buenos Aires (AR)

(72) Inventors: Martin Mauro Nebiolo, Neuquen (AR); Christian Cerne, Spring, TX (US); Gustavo Dietrich, Neuquen (AR); Cristian Brendstrup, Neuquen (AR)

(73) Assignee: UNIVERSAL COMPLETIONS LLC, Buenos Aires (AR)

( * ) Notice: Subject to any disclaimer, the term of this patent is extended or adjusted under 35 U.S.C. 154(b) by 0 days.

(21) Appl. No.: 19/424,229

(22) Filed: Dec. 18, 2025

(51) Int. Cl.
*E21B 34/14* (2006.01)
*E21B 23/00* (2006.01)

(52) U.S. Cl.
CPC ..... *E21B 34/142* (2020.05); *E21B 23/006* (2013.01)

(58) Field of Classification Search
CPC ..... E21B 34/142; E21B 23/006
See application file for complete search history.

(56) References Cited

U.S. PATENT DOCUMENTS 3,442,328 A * 5/1969 Nutter ..... E21B 23/006 166/152
5,287,930 A * 2/1994 McGill ..... E21B 34/12 166/373
12,252,944 B1 3/2025 Nebiolo
2017/0342806 A1* 11/2017 Themig ..... E21B 33/12

* cited by examiner

*Primary Examiner* — James G Sayre
(74) *Attorney, Agent, or Firm* — Carter, DeLuca & Farrell LLP

(57) ABSTRACT

Multi-cycle circulation valve activated by balls is provided including a unified tubular tool that integrates an upper sub, an upper housing, a mobile mandrel assembly, a ball activation system, a lower sub, a lower mandrel with machined J-slots consisting of two helical channels of different lengths, where guide pins transversely mounted through a synchronizing sleeve are channeled into the slots during axial movement of the piston. The lower mandrel extension incorporates elastomeric rings that provide dynamic sealing with the perforated housing, while radial circulation ports selectively align with housing ports to establish controlled hydraulic communication. The ball receiver features stepped internal geometry with seven evenly distributed millings for multi-cycle capture. The graphite-filled Teflon deformable balls of 11/16 inch activate the system, generating controlled rotations of 95.6° and 84.4°, producing a total angular displacement of 180° after two complete cycles, enabling automatic switching between direct flow mode and annular circulation without requiring well retrieval.

6 Claims, 4 Drawing Sheets

MULTI-CYCLE CIRCULATION VALVE ACTIVATED BY BALLS

TECHNICAL FIELD

This invention relates to a multi-cycle circulation valve activated by balls for flow control in oil, gas, or geothermal wells through drilling, completion, or intervention tubing. The device belongs to the field of downhole tools that optimize selective flow control between the tubular interior and the annular space.

The device alternates in a controlled manner between direct flow and annular circulation mode through sequential activation with single-size deformable balls, providing greater operational versatility, simplified mechanical design, and significant cost reduction compared to conventional systems that require multiple tools or balls of different diameters.

The novel technical solution employs a piston system with J-slots equipped with two channels of different lengths, allowing multiple operational cycles within the well, eliminating the need to bring the tool back to surface. The invention meets the requirements of novelty and inventive step for patent protection.

BACKGROUND

The present development falls within the field of downhole tools for flow control operations, specifically focusing on valves that enable switching between direct flow and annular circulation mode. In various drilling, completion, and intervention applications, it is beneficial to selectively alternate fluid flow between the interior of the tubing and the surrounding annular space to optimize cleaning, circulation, and pressure control operations.

Controlling fluid flow within a tubular string deployed in a well is often critical to the success and efficiency of downhole operations. In many cases, it is desirable to allow fluid to pass through a specific section of the tubular string during certain phases of the operation, while preventing flow through that same section during other phases. Similarly, there may be a need to selectively enable or restrict fluid flow between the internal diameter of the tubular and the annulus by controlling flow through lateral ports.

Some systems provide this functionality through fully hydraulic mechanisms that switch between direct and annular flow modes by briefly reducing or interrupting the flow and then restoring it. Other systems rely on mechanical activation using pumped balls, with certain designs requiring balls of different diameters or multiple balls per activation cycle.

Hydraulic systems are prone to failure in wells with pressure imbalance or unstable pressure profiles, which can compromise their reliability. Ball-operated systems that require multiple balls or balls of different sizes increase operational complexity and cost, making them more susceptible to human error during activation.

U.S. Pat. No. 12,252,944 describes a dual-mode circulation tool activated by fluid that enables switching between direct flow and annular flow mode by interrupting and restoring pressurized fluid flow. The system comprises a ratchet tube with a zigzag path featuring alternating peaks and valleys, longitudinal peak channels, and a rotating cage cylinder with flow channels and metallic sealing balls.

The mechanism operates through downward strokes of the ratchet tube caused by pressurized fluid flow, which induces rotation of the cage cylinder and alternates the alignment of the flow channel outlets with the inlets of the ejection path assemblies, causing the sealing balls to alternately seal the inlets of the different fluid ejection path assemblies.

While the prior art uses a ratchet system with a zigzag path and requires flow interruption and restoration for activation, this invention employs a J-slot system with two helical channels of different specific lengths that induce precise controlled rotations of 95.6° and 84.4°, resulting in a total angular displacement of 180° after two complete cycles.

A critical difference is that the prior art requires metallic sealing balls confined within the flow channels of the cage cylinder for alternate sealing, whereas the present development uses 11/16-inch graphite-filled Teflon deformable activating balls that pass through the system and are captured in a specialized receiver with a stepped geometry and seven evenly distributed millings.

The prior art system depends on flow interruption for activation, while the present development operates through continuous activation with deformable balls without requiring surface flow interruption. Additionally, the prior art uses fixed external and internal pins for coupling with the ratchet tube and cage cylinder, respectively, whereas the proposed development employs guide pins transversely mounted through the synchronizing sleeve, which are channeled into the J-slots during axial movement.

Despite these advancements, there remains a need for devices that combine multi-cycle operation within the well, activation with uniform elements, and precise control through specific rotational mechanisms, all without requiring tool recovery to the surface. Consequently, it is evident that none of the prior art contemplates the specific combination of a J-slot system with precise rotation angles, activation by deformable balls made of specific material, multi-cycle operation without flow interruption, and an integrated receiver with permanent capture of activating elements.

This technological gap justifies the development of the proposed solution, which integrates these novel features into a unified tool that overcomes the limitations of operational complexity, reliability, and cost-efficiency identified in the known state of the art.

SUMMARY

The present invention relates to a multi-cycle circulation valve activated by balls, configured as a unified tubular tool for flow control operations in wells. It employs a piston with machined J-slots featuring two helical channels of different lengths, enabling automatic switching between direct flow and annular circulation mode through single-size graphite-filled Teflon deformable balls that induce controlled rotations of 95.6° and 84.4°, resulting in a total angular displacement of 180° after two complete cycles. The tool incorporates an integrated receiver with a stepped geometry that permanently captures the deformable balls, allowing multi-cycle operation within the well without requiring retrieval of the tool to surface. In annular circulation mode, the valve maintains hydraulic communication both to the annulus and the tubular interior, with the lower pressure drop of the annular ports compared to tools positioned below preferentially directing flow toward the annular space. This simplifies operations, reduces costs, and provides precise flow control through specific rotation angles that ensure reliable performance under severe downhole conditions.

BRIEF DESCRIPTION OF THE DRAWINGS

To illustrate the advantages briefly mentioned above-along with many others that users and experts in the field may identify- and to facilitate understanding of the structural, constitutive, and functional characteristics of the invented device, a preferred embodiment is described below. This embodiment is schematically illustrated in the accompanying drawings without a defined scale, with the express clarification that, being merely an example, it should not be considered limiting or exclusive of the scope of protection of the present invention, but rather serves an explanatory and illustrative purpose of the basic concept on which it is founded.

DETAILED DESCRIPTION

This invention relates to a multi-cycle circulation valve activated by balls, designed as an integrated tool for flow control operations in wells. The mechanism is based on a piston system with a J-slot equipped with two distinct channels—one longer than the other—where a set of stationary guide pins remains fixed relative to the J-slot piston. During the longitudinal movement of the piston, both upward and downward, the guide pins engage and follow one of the two channels in the J-slot, inducing a rotational movement of 95.6° when switching from direct flow mode to annular mode, and 84.4° when switching from annular mode back to direct flow mode, such that the completion of two full cycles results in a total angular displacement of 180°.

During operation in direct flow mode, the tracking of the longer helical channel by the stationary guide pins strategically positions the elastomeric seals both above and below the radial ports of the outer housing. This geometric configuration establishes a hermetic seal that completely blocks communication to the annular space, directing the entire fluid flow through the internal diameter of the mandrel assembly toward the tools positioned below in the string.

In the annular circulation configuration, the guide pins travel through the shorter helical channel, establishing precise alignment between the radial ports of the piston and the corresponding ports of the perforated housing. This controlled circumferential alignment creates multiple radial flow paths that enable direct hydraulic communication between the interior of the tool and the surrounding annular space, facilitating well circulation and cleaning operations.

Figure 1:
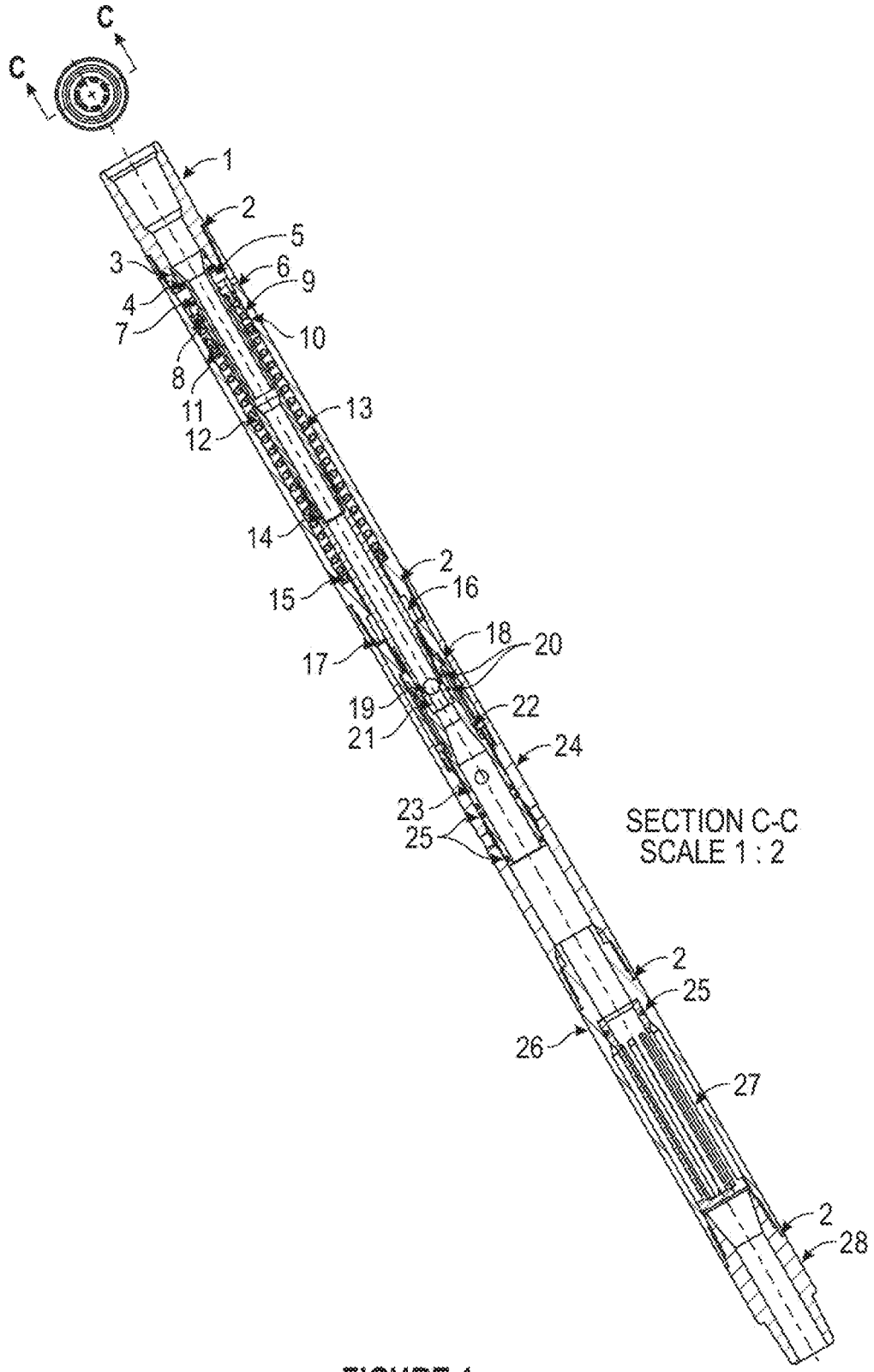
FIG. 1 shows a longitudinal sectional view of the complete device, subject of the present invention, according to one dimensional embodiment thereof.

With reference to FIG. 1, the assembly is structured as a unified tubular tool extending longitudinally. At the upper end is the upper sub (1), which provides the connection interface with the drill string. It is configured as a thick-walled cylindrical tubular element with externally threaded geometry. This component (1) has an outer diameter compatible with standard work string specifications and a constant inner diameter that forms the main fluid inlet, functionally acting as the entry point for fluid from the surface and as the mechanical pulling element for the entire assembly.

The first elastomeric ring, specification 2-037 (2), is positioned in a machined annular groove in the upper sub (1), providing static sealing at the upper connection of the assembly to prevent external leakage. The second elastomeric ring, specification 2-127 (3), is installed in an annular groove of the deflector (5), establishing additional sealing at the upper interface of the mechanism.

The internal Seeger ring, diameter 42 (4), is positioned as a mechanical retaining element in the upper sub (1), providing axial retention for internal components and preventing undesired displacement during operation. The deflector (5) is a protective element located in the upper section of the assembly, designed to direct fluid flow and shield sensitive internal components from direct impact during activation operations.

The main structure consists of the upper housing (6), configured as a robust thick-walled cylindrical tubular body with stepped internal geometry, centrally positioned in the assembly as a containment element that houses the moving components of the mechanism. This upper housing (6) acts as a supporting structure that contains and aligns the internal elements of the J-slot system.

The third elastomeric ring, specification 2-215 (7), is positioned in a machined annular groove in the spring seat (9), providing dynamic sealing against the deflector (5) during upward and downward movement of the lower mandrel (18). The fourth elastomeric ring, specification 2-125 (8), is installed in the spring seat (9), establishing static sealing at the connection between the spring seat (9) and the upper mandrel (12) to maintain pressure integrity in the upper section of the mechanism.

The spring seat (9) serves as a support base specifically designed to house and position the compression spring (13), providing a controlled contact surface that evenly distributes compression and expansion forces during operational cycles. It also fulfills the critical function of providing dynamic sealing through elastomeric rings (7) and (10) housed in its grooves, which seal against the deflector (5) and the upper housing (6), respectively, during movement of the lower mandrel (18). The fifth elastomeric ring, specification 2-225 (10), is positioned in the spring seat (9), providing dynamic sealing against the upper housing (6) during movement of the mobile assembly, preventing pressure leakage at this critical interface.

The upper thrust bearing (11) is installed as an axial support element that facilitates the controlled rotational movement of the mobile components while bearing axial loads generated during mechanism activation. This bearing (11) reduces friction during the rotations induced by the J-slot system. The upper mandrel (12) constitutes the upper section of the mobile mandrel assembly, configured with internal geometry that allows fluid passage and mechanical connection with the intermediate mandrel (16).

The central force element of the system is the compression spring (13), configured as a calibrated helical spring that provides the return force necessary for the mechanism's operation. This spring (13) is positioned between the upper thrust bearing (11) at its upper end and the lower thrust bearing (15) at its lower end, remaining confined within the upper housing (6). During the downward movement of the mandrel assembly, the spring (13) compresses between these two support points, accumulating potential energy that is later released to drive the upward movement completing each activation cycle.

The sixth elastomeric ring, specification 2-022 (14), is installed in the intermediate mandrel (16), providing static sealing during the simultaneous axial and rotational movement of the threaded mandrel assembly (12) and (16), acting as a critical element for pressure integrity during activation cycles. The lower thrust bearing (15) is positioned as the lower axial support complementing the upper thrust bearing (11), facilitating rotational movement of the mandrels while distributing axial loads in the lower section of the mobile mechanism.

The intermediate mandrel (16) serves as the middle section of the mandrel assembly, providing structural continuity between the upper mandrel (12) and the lower mandrel (18). This component (16) incorporates stepped internal geometry that allows axial fluid passage while maintaining rigid mechanical connection with adjacent mandrels, ensuring that the entire mobile assembly acts as a unit during activation cycles and supports both compression loads during downward movement and tensile loads during the upward return induced by the compression spring (13).

The synchronizing sleeve (17) is a coupling element that coordinates movement between the different mandrels of the assembly, ensuring that the mobile system completes rotation cycles in a synchronized and controlled manner. This sleeve (17) is specifically housed within the intermediate mandrel (16) and transversely houses the guide pins (22), which are channeled into the J-slots (29) of the lower mandrel (18). These pins (22) are the elements that induce controlled rotation of the mandrel assembly during axial movement and provide support surfaces for sealing elements.

The most critical component of the mechanism is the lower mandrel (18), which features on its outer surface the characteristic precisely machined J-slots. These slots consist of two helical channels of different lengths and angles-one shorter for switching to annular circulation mode and one longer for returning to direct flow mode. The lower mandrel (18) is part of the mobile mandrel assembly and is threaded to the lower mandrel extension (23), which houses the sealing elements.

The 11/16-inch ball (19) is the activation element of the system, specifically dimensioned to seat in the ball seat (21). This ball (19) is made of graphite-filled Teflon, allowing its controlled passage through the seat upon reaching a predetermined pressure threshold, initiating each activation cycle of the mechanism.

The seventh elastomeric ring, specification 2-121 (20), is positioned in the intermediate mandrel (16), providing static sealing as the intermediate mandrel (16) and lower mandrel (18) are threaded together and move in unison during the helical movement of the mandrel assembly, withstanding complex operational conditions generated by simultaneous axial and rotational movement. The ball seat (21) is a calibrated seat located inside the lower mandrel (18), beneath the intermediate mandrel (16), specifically designed to receive the ball (19) and dimensioned to allow temporary seating of the ball (19) under increasing pressure until the deformation threshold is reached, at which point the ball (19) passes through the seat (21), instantly releasing the accumulated pressure.

The fundamental elements for the operation of the J-slot system are the guide pins (22), which are stationary pins fixed relative to the mobile mandrel assembly. These pins (22) are inserted into the J-slots of the lower mandrel (18) and remain stationary while the mandrel assembly performs axial movement, forcing controlled rotation during longitudinal movement and inducing the rotational motion that characterizes the mechanism.

The lower mandrel extension (23) is threaded to the lower mandrel (18) and houses the elastomeric seal assembly that provides dynamic sealing with the perforated housing (24). It also incorporates radial ports that selectively align with the ports of the perforated housing (24) to establish annular circulation, featuring internal geometry that allows fluid flow continuity toward the lower section of the mechanism and controlled diversion of flow to the annular space during circulation configuration. This extension (23) specifically houses the mechanical interface with the perforated housing (24) and allows continuity of direct flow through its internal diameter, facilitating the passage of the deformable balls (19) toward the receiver (27) positioned at the lower end of the assembly.

The perforated housing (24) is a stationary cylindrical housing containing circumferentially distributed calibrated radial ports, which selectively align with the corresponding ports of the lower mandrel extension (23) to establish hydraulic communication to the annulus, or remain sealed when misaligned to maintain direct flow. This housing (24) constitutes the fundamental stationary element of the flow switching system. In this section, an elastomeric ring, specification 2-037 (2), is installed in the lower housing (26) to provide additional sealing at this critical system interface.

The eighth elastomeric ring, specification 2-223 (25), is strategically installed in the lower mandrel extension (23), acting as a critical sealing element that blocks communication between the ports of the lower mandrel extension (23) and the ports of the perforated housing (24) when misaligned, ensuring complete hermeticity during direct flow configuration and providing a sealed chamber during annular circulation configuration.

The lower housing (26) serves as the lower support structure that houses the final components of the mechanism and provides the interface with the ball capture system, remaining stationary while the mobile components perform their activation cycles. The ball receiver (27) is designed as a capture chamber with stepped internal geometry of progressive diameters and evenly distributed millings, offering sufficient volume to house multiple deformed balls (19) without obstructing fluid flow. This chamber (27) facilitates the capture and retention of balls (19) that have completed their activation function, enabling multi-cycle operation without requiring retrieval of the deformed balls (19).

Additionally, an elastomeric ring, specification 2-037 (2), is housed in a machined groove in the lower housing (26), providing static sealing against the perforated housing (24) at this intermediate connection of the mechanism, maintaining pressure integrity in the switching section.

The lower sub (28) constitutes the base of the assembly, including an external threaded connection for interfacing with tools positioned below and providing free fluid passage toward the downhole assembly. An elastomeric ring, specification 2-037 (2), is housed in a machined groove in the lower sub (28), providing static sealing against the lower housing (26) at this lower connection of the assembly, preventing leakage between these structural components.

The assembly operates through the sequential interaction of all numbered components. The ball (19) seats in the ball seat (21), where increasing pressure compresses the spring (13) as the mobile assembly descends and the guide pins (22) follow the corresponding channel in the J-slots. During this movement, the lower mandrel (18) rotates by the specific angle according to the active channel, until the ball (19) deforms upon reaching the pressure threshold and passes through the seat. The instant pressure release allows the spring (13) to expand, forcing the upward movement and completing the rotation. The deformed ball (19) is captured in the receiver (27) as the system reaches its new operational configuration, either direct flow or annular circulation.

This configuration provides a unified solution that replaces multiple systems, reducing operational complexity and associated costs while maintaining precise flow control in downhole applications. The multi-cycle operation eliminates the need for well retrieval, while the use of single-size balls (19) simplifies surface operations. The robust design with calibrated components withstands extreme downhole conditions, complemented by multiple sealing levels that ensure system integrity. The integrated ball (19) capture prevents obstructions caused by deformed balls (19), and the specific rotation angles provide exact positioning for precise flow control.

FIGS. 2*a* to 2*h* provide technical evidence of the mechanism's multi-cycle operation, showing the precise transition between operational configurations without requiring well retrieval or external intervention.

Figure 2A:
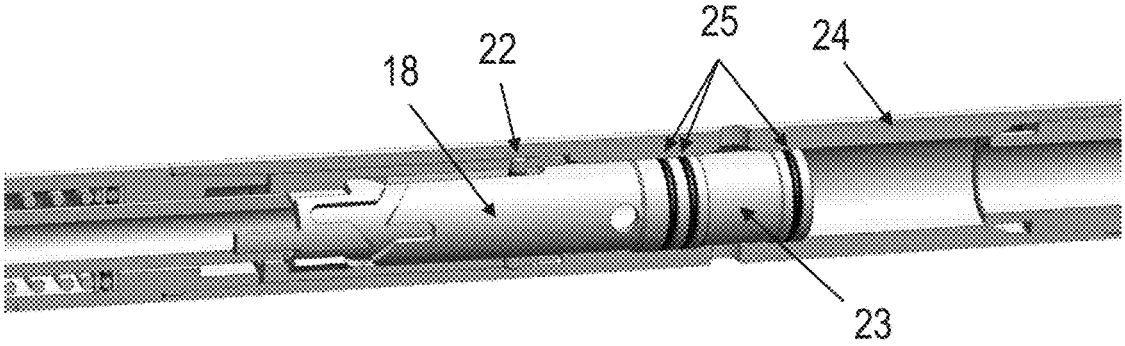
FIGS. 2*a* to 2*h* show perspective views of the complete operational sequence of the mechanism, illustrating the controlled transition between direct flow and annular circulation configurations during two complete activation cycles, subject of the present invention, according to one dimensional embodiment thereof.

FIG. 2*a* presents a perspective view of the critical section of the mechanism in direct flow configuration, where the guide pin (22) is positioned at the tip of the long channel of the J-slot in the lower mandrel (18). In this configuration, the radial ports of the lower mandrel extension (23) are completely misaligned with the ports of the perforated housing (24), while the elastomeric rings, specification 2-223 (25), positioned in the lower mandrel extension (23), block any communication to the annulus, establishing direct flow where the pressurized fluid passes entirely toward the lower tools without diversion to the circumferential annular space.

Figure 2B:
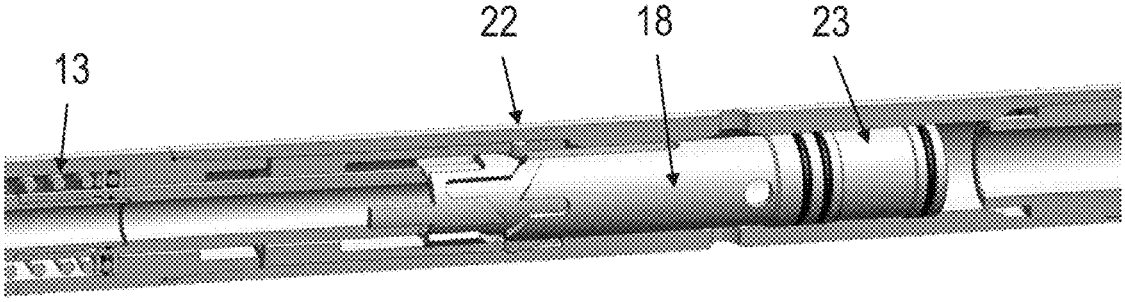

FIG. 2*b* illustrates the initial phase of the activation cycle where the ball (19) seats in the ball seat (21) and the downward stroke of the lower mandrel (18) begins. In this representation, the guide pin (22) starts its path through the J-slot of the lower mandrel (18), while the lower mandrel extension (23) moves axially under the pressure exerted by the seated ball (19). This configuration shows the specific moment when the compression spring (13) begins to compress and the mobile assembly initiates its downward movement, which will subsequently induce the controlled rotation of the mechanism.

Figure 2C:
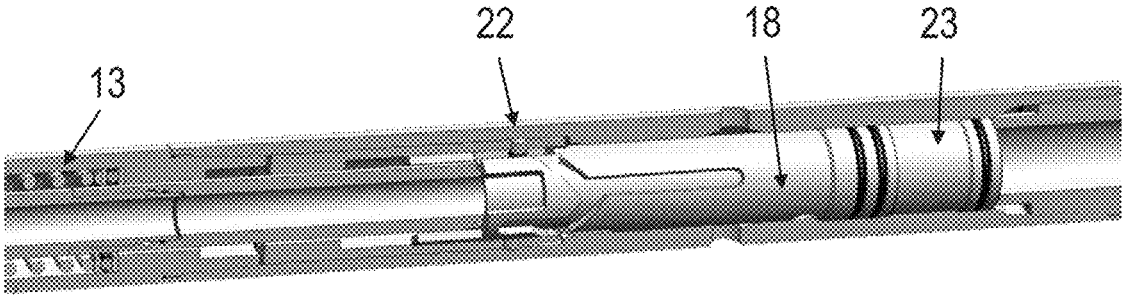

FIG. 2*c* represents the critical moment when the ball (19) reaches its deformation threshold and passes through the seat into the ball receiver (27). At this phase, the compression spring (13) is in its fully compressed state, while the guide pin (22) has completed its path through the corresponding channel of the J-slot in the lower mandrel (18). The lower mandrel extension (23) is at its maximum axial displacement, at which point the instantaneous pressure release caused by the ball (19) passing through the seat allows the spring (13) to begin expanding, forcing the upward movement of the mobile assembly.

Figure 2D:
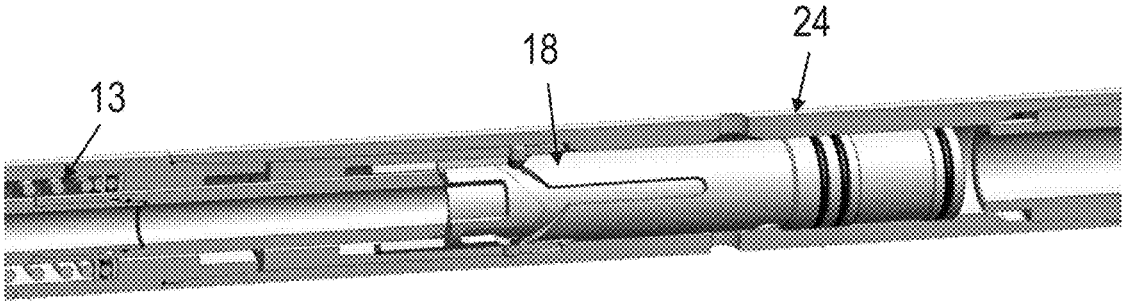

FIG. 2*d* shows the beginning of the upward stroke of the lower mandrel (18) driven by the expansion of the compression spring (13), as the mobile assembly moves toward the next annular circulation position. In this phase, the radial ports of the lower mandrel extension (23) progressively approach alignment with the ports of the perforated housing (24), while the guide pin (22) follows its return path through the J-slot.

This configuration represents the transition to annular circulation mode, where controlled hydraulic communication is established between the interior of the tool and the surrounding annular space.

Figure 2E:
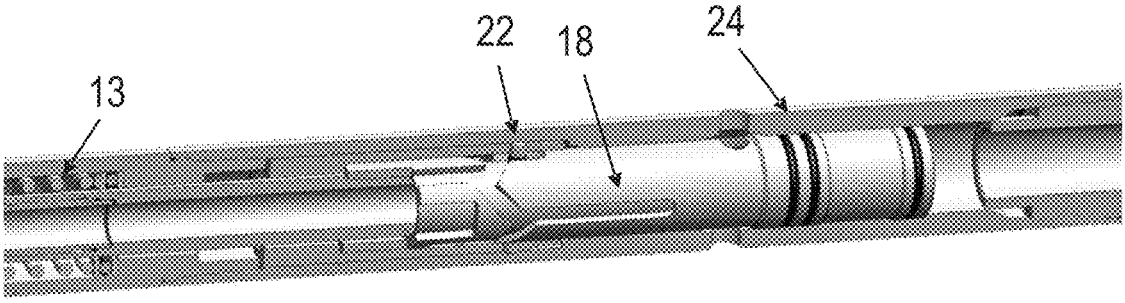
Figure 2F:
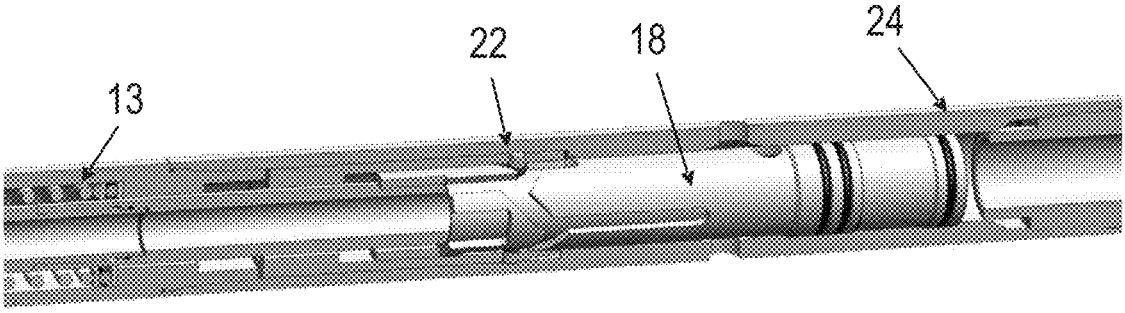

FIG. 2*e* shows the completion of the upward stroke of the lower mandrel (18), setting the discharge position for annular circulation. In this final configuration, the radial ports of the lower mandrel extension (23) are fully aligned with the ports of the perforated housing (24), establishing direct hydraulic communication to the annular space. The guide pin (22) is positioned at the tip of the short channel of the J-slot, determining the exact rotational position that enables controlled flow from the interior of the tool to the surrounding annulus, thus completing the mechanism's switching cycle FIG. 2*f* illustrates the beginning of the second activation cycle, where a new ball (19) lands in the ball seat (21) and initiates the downward stroke of the lower mandrel (18) from the annular circulation configuration. In this representation, the compression spring (13) is in its expanded state while the guide pin (22) begins a new path through the J-slot of the lower mandrel (18). This configuration demonstrates the mechanism's multi-cycle capability, where the system can alternate again between operational modes through activation with a second ball (19), initiating the transition from annular circulation to the next direct flow configuration.

Figure 2G:
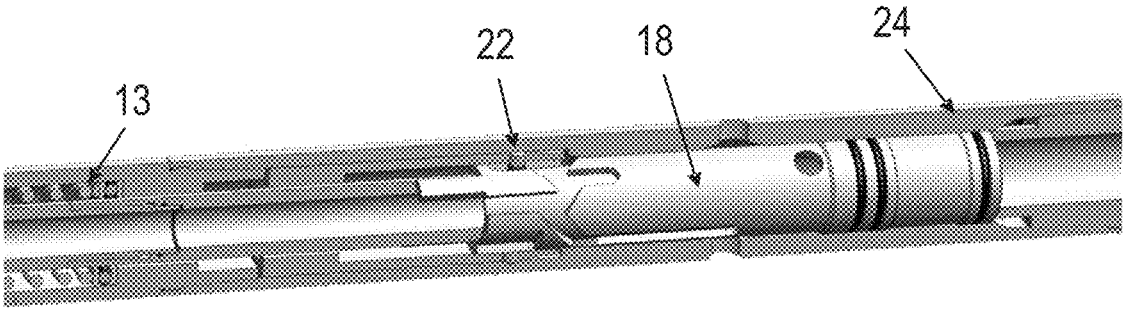

FIG. 2*g* represents the completion of the downward stroke of the second cycle, where the lower mandrel (18) reaches its maximum axial displacement under the action of the second activating ball (19). In this configuration, the compression spring (13) is once again in its fully compressed state, while the guide pin (22) has completed its path through the long channel of the J-slot in the lower mandrel (18). This position corresponds to the moment just before the deformation of the second ball (19) and its passage into the receiver, preparing the system for the upward return that will reestablish the direct flow configuration, demonstrating the full reversibility of the mechanism.

Figure 2H:
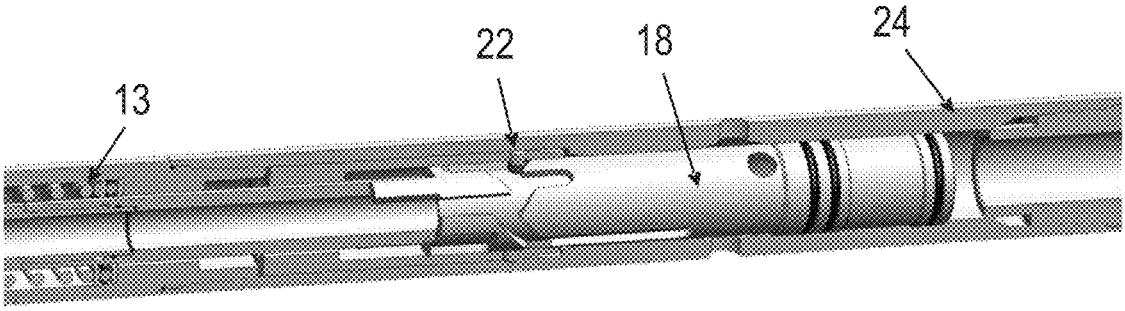

FIG. 2*h* illustrates the beginning of the upward stroke of the lower mandrel (18) during the second cycle, driven by the expansion of the compression spring (13) after the second ball (19) passes into the receiver. In this configuration, the mobile assembly moves toward the next direct flow position, where the elastomeric rings (25) installed in the lower mandrel extension (23) progressively approach their final position, in which they are located above and below the ports of the perforated housing (24), completely blocking communication to the annulus. The guide pin (22) follows its return path through the short channel of the J-slot, completing the total angular displacement of 180° after two full activation cycles, demonstrating the full functionality of the multi-cycle mechanism.

Figure 3:
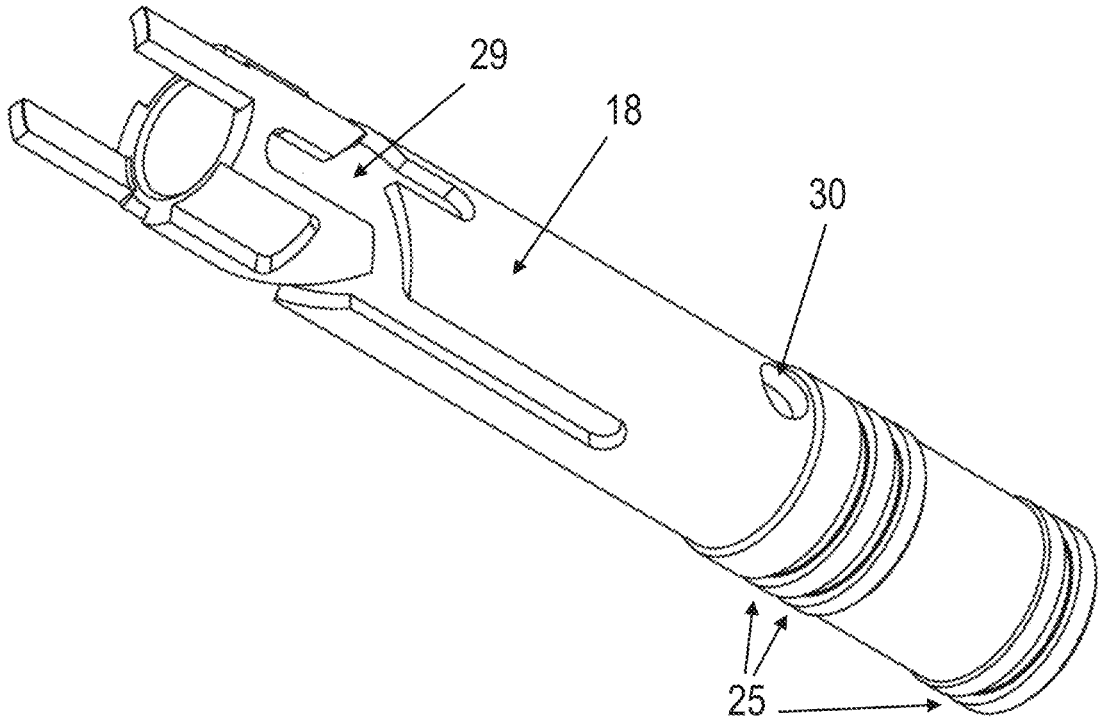
FIG. 3 shows an isometric perspective view of the assembled set formed by the lower mandrel (18) and the lower mandrel extension (23), subject of the present invention, according to one dimensional embodiment thereof.

FIG. 3 presents an isometric perspective view of the assembled set formed by the lower mandrel (18) and the lower mandrel extension (23), showing the integral configuration of the mechanism's most critical mobile component. The machined J-slots (29) are clearly visible on the outer surface of the lower mandrel (18), providing the helical channels that interact with the stationary guide pins (22) to generate the system's controlled rotation. The radial circulation ports (30) are positioned as two Ø15 perforations distributed 180° apart on the lower mandrel extension (23) to allow controlled flow to the annular space during circulation configuration. The lower mandrel extension (23) incorporates the sealing interface with the perforated housing (24) for flow control, where the machined grooves for housing the elastomeric rings (25) are visible. This representation illustrates the functional unit that performs both axial and rotational movement during the activation cycles of the multi-cycle mechanism.

Figure 4:
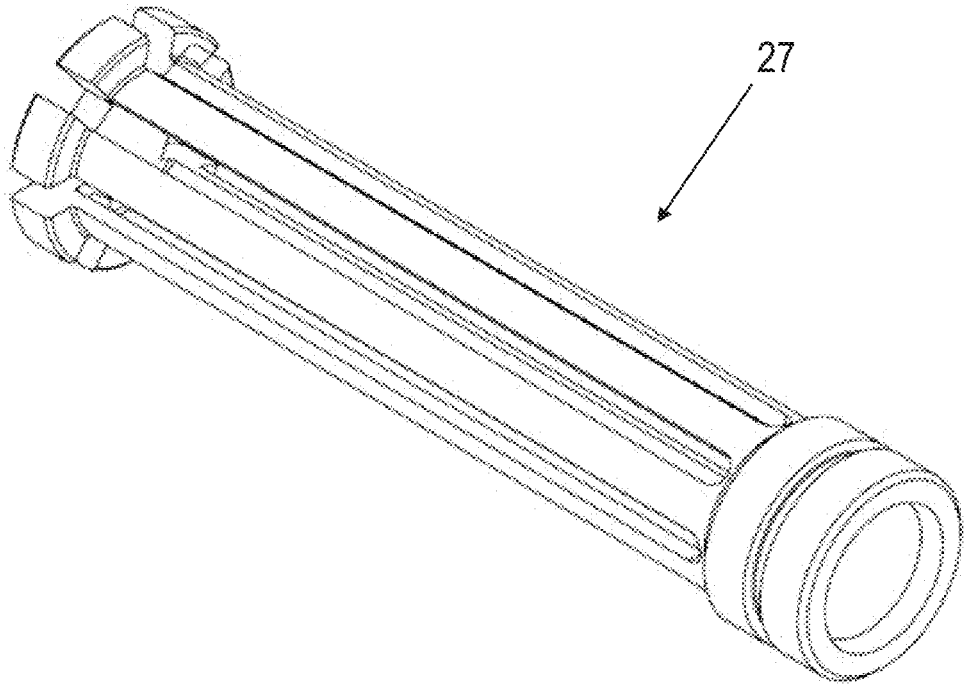
FIG. 4 shows an isometric perspective view of the ball receiver, subject of the present invention, according to one dimensional embodiment thereof.

FIG. 4 presents an isometric perspective view of the ball receiver (27), showing its cylindrical configuration with stepped internal geometry of progressive diameters, specifically designed for the capture and retention of deformed balls (19). The receiver (27) features seven evenly distributed identical millings around the circumference that facilitate the retention of balls (19) that have completed their activation function, enabling multi-cycle operation of the mechanism without fluid flow obstruction or the need to retrieve the captured balls (19).

Having thus specifically described and defined the nature of the present invention and the manner in which it is to be implemented, the following is claimed as proprietary and exclusive rights:

1. A multi-cycle circulation valve activated by balls, comprising:

a unified tubular tool for flow control operations in oil, gas, or geothermal wells, enabling automatic switching between direct flow mode and annular circulation mode through single-size deformable balls, generating controlled rotation that produces a total angular displacement of 180° after two complete activation cycles without requiring well retrieval;

a lower mandrel configured as a cylindrical tubular element with machined J-slots on its outer surface, consisting of two helical channels of different lengths;

guide pins configured as cylindrical elements transversely mounted through a synchronizing sleeve, distributed at 180°, which are channeled into the J-slots during axial movement of the lower mandrel;

a lower mandrel extension configured as a threaded tubular extension mechanically connected to the lower mandrel and provided with machined grooves for housing sealing elements;

a perforated housing configured as a stationary cylindrical housing with circumferentially distributed calibrated radial ports;

elastomeric rings, specification 2-223, housed in the grooves of the lower mandrel extension, providing dynamic sealing with the perforated housing;

radial circulation ports configured as perforations distributed at 180° on the lower mandrel extension, selectively aligning with the ports of the perforated housing to establish controlled hydraulic communication; and a ball receiver configured as a cylindrical chamber with stepped internal geometry of progressive diameters and seven identical evenly distributed radial millings positioned at a lower end.

2. The multi-cycle circulation valve activated by balls, according to claim 1, wherein the machined J-slots comprise a long channel extending 164 mm with specific angles of 28.3°, 35.1°, 49.3°, and 67.3°, and a short channel with differentiated angular development inducing rotations of 95.6° and 84.4°, respectively.

3. The multi-cycle circulation valve activated by balls, according to claim 1, wherein the guide pins are channeled into the J-slots, alternately following long and short channels during axial movement of the mobile assembly, wherein the guide pins have a diameter of Ø8 mm and are transversely mounted through holes in a synchronizing sleeve positioned in an intermediate mandrel.

4. The multi-cycle circulation valve activated by balls, according to claim 1, wherein the ball receiver facilitates capture and retention of the deformable balls, and wherein the ball receiver is configured as a cylindrical chamber of 200 mm length with stepped internal geometry of progressive diameters, featuring seven identical radial millings evenly distributed at angular intervals of 51.4°.

5. The multi-cycle circulation valve activated by balls, according to claim 1, wherein the multi-cycle circulation valve provides return force for upward movement of a mobile assembly, and further comprises a calibrated compression spring positioned between an upper thrust bearing and a lower thrust bearing.

6. The multi-cycle circulation valve activated by balls, according to claim 1, wherein the multi-cycle circulation valve allows controlled passage through a ball seat, wherein the deformable balls have a dimension of 11/16 inch and are made of graphite-filled Teflon.

* * * * *